US009829004B2

(12) United States Patent
Ikeda et al.

(10) Patent No.: US 9,829,004 B2
(45) Date of Patent: Nov. 28, 2017

(54) TURBO FAN AND AIR CONDITIONER

(71) Applicant: Mitsubishi Electric Corporation, Tokyo (JP)

(72) Inventors: Takashi Ikeda, Tokyo (JP); Masahiko Takagi, Tokyo (JP); Makoto Kurihara, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 325 days.

(21) Appl. No.: 14/428,484

(22) PCT Filed: Oct. 15, 2013

(86) PCT No.: PCT/JP2013/077930
§ 371 (c)(1),
(2) Date: Mar. 16, 2015

(87) PCT Pub. No.: WO2014/061642
PCT Pub. Date: Apr. 24, 2014

(65) Prior Publication Data

US 2015/0226227 A1 Aug. 13, 2015

(30) Foreign Application Priority Data

Oct. 16, 2012 (WO) ..... PCT/JP2012/076670

(51) Int. Cl.
*F04D 29/28* (2006.01)
*F04D 25/08* (2006.01)
(Continued)

(52) U.S. Cl.
CPC ..... *F04D 25/088* (2013.01); *F04D 19/002* (2013.01); *F04D 29/281* (2013.01);
(Continued)

(58) Field of Classification Search
CPC ..... F04D 29/281; F04D 29/30; F04D 29/384; F04D 29/388; F04D 19/002; F04D 25/088; F05D 2240/303
See application file for complete search history.

(56) References Cited

U.S. PATENT DOCUMENTS 8,007,240 B2 * 8/2011 Sanagi ..... F04D 29/282 29/889.4
8,834,121 B2 9/2014 Ikeda et al.
(Continued)

FOREIGN PATENT DOCUMENTS

CN 102459917 A 5/2012
EP 2441963 A1 * 4/2012 ..... F04D 25/088
(Continued)

OTHER PUBLICATIONS

Office Action dated Dec. 26, 2016 issued in corresponding CN patent application No. 201380054114.8 (and English translation).
(Continued)

*Primary Examiner* — Dwayne J White
*Assistant Examiner* — Sang K Kim
(74) *Attorney, Agent, or Firm* — Posz Law Group, PLC

(57) ABSTRACT

Provided is a turbofan including a shroud, a main plate, and a plurality of blades. A main plate-side shoulder surface portion is curved so as to be distanced from the rotational center axis while approaching the blade trailing edge as the main plate-side shoulder surface portion is distanced from a main plate-side blade tip portion, and has a convexoconcave shape including a blade tip section and the main plate-side blade tip portion. An inner peripheral-side leading edge section includes the inner peripheral-side blade leading edge section main plate-side portion and an inner peripheral-side blade leading edge section tip-side portion including curves that protrude rearward in the rotational direction.

7 Claims, 9 Drawing Sheets

(51) Int. Cl.

| | |
|---|---|
| ***F04D 29/30*** | (2006.01) |
| ***F04D 19/00*** | (2006.01) |
| ***F04D 29/38*** | (2006.01) |

(52) U.S. Cl.
CPC ..... *F04D 29/30* (2013.01); *F04D 29/384* (2013.01); *F04D 29/388* (2013.01); *F05D 2240/303* (2013.01)

(56) References Cited

U.S. PATENT DOCUMENTS

| | | | | |
|---|---|---|---|---|
| 9,528,374 | B2 * | 12/2016 | Ikeda | F04D 29/281 |
| 2007/0098556 | A1 | 5/2007 | Sanagi et al. | |
| 2011/0023526 | A1 | 2/2011 | Ohyama | |
| 2012/0055656 | A1 * | 3/2012 | Han | F04D 29/30 165/122 |
| 2015/0030454 | A1 | 1/2015 | Ikeda et al. | |

FOREIGN PATENT DOCUMENTS

| | | | |
|---|---|---|---|
| JP | 3391319 | B2 | 1/2003 |
| JP | 2003-232295 | A | 8/2003 |
| JP | 3649157 | B2 | 2/2005 |
| JP | 2010-053803 | A | 3/2010 |
| JP | 4612084 | B2 | 10/2010 |
| JP | 2010-285925 | A | 12/2010 |
| WO | 2009/139422 | A1 | 11/2009 |

OTHER PUBLICATIONS

Office Action dated Oct. 27, 2015 in the corresponding JP application No. 2014-542134 (with English translation).
International Search Report of the International Searching Authority dated Jan. 14, 2014 for the corresponding international application No. PCT/JP2013/077930 (and English translation).
Office Action dated Jul. 17, 2017 issued in corresponding CN patent application No. 201380054114.8 (and English translation).

* cited by examiner

TURBO FAN AND AIR CONDITIONER

CROSS REFERENCE TO RELATED APPLICATIONS

This application is a U.S. national stage application of International Patent Application No. PCT/JP2013/077930 filed on Oct. 15, 2013, and is based on International Patent Application No. PCT/JP2012/076670 filed on Oct. 16, 2012, the contents of which are incorporated herein by reference.

TECHNICAL FIELD

The present invention relates to a turbofan and an air conditioner.

BACKGROUND ART

Hitherto, a turbofan including a plurality of blades formed into a three-dimensional shape has been widely employed as a blower fan to be installed in a ceiling-concealed air conditioner. For example, the following turbofan is disclosed in Patent Literature 1. In each of the blades, a concave-shaped portion is formed at substantially a center part in an axial direction (height direction) in a leading edge section, and convex-shaped portions are formed at parts on a main plate side and on a shroud side in the leading edge section. In each of the blades, the leading edge on the shroud side is positioned on the forward side in the rotational direction with respect to the leading edge on the main plate side.

In the turbofan configured as described above, the leading edge section is inclined forward so that, as described above, the shroud side of the leading edge section of the blade is positioned on the forward side in the rotational direction with respect to the main plate side of the leading edge section. Therefore, the fan can appropriately adapt to the velocity distribution of the suction flow, and the flow is less liable to separate on the shroud side.

Further, with the concave-shaped portion formed at the center position in the height direction and the convex-shaped portions formed respectively on the shroud side and on the main plate side, even when the airflow rate is lower than the design point, a large-scale separation vortex, which is generated at the blade leading edge section, may be decreased in size. Specifically, the separation vortex is divided into two small vortices by the two convex-shaped portions, to thereby decrease the size of the separation vortex and suppress reduction in area just behind the blade entrance, which is caused when the vortex is formed so as to block the entrance. As a result, reduction in noise and increase in efficiency can be expected not only at the design point but also when the airflow rate is low.

Further, for example, in Patent Literature 2, there is disclosed a turbofan including a plurality of blades each having a stepped surface formed at the leading edge so as to be formed into a discontinuous shape in the span direction. The stepped surface is formed as an inclined surface having a predetermined inclination angle with respect to a plane perpendicular to the rotational axis. Further, there is also disclosed a mode configured so that, in the leading edge of each of the blades, a part closer to the hub with respect to the stepped surface is formed into a shape that is gradually protruded forward from the stepped surface toward the hub, in other words, the chord length of each of the blades is changed so as to increase from the stepped surface toward the hub.

In the turbofan configured as described above, the flow turbulence is caused through collision with the discontinuous surface, and thus a longitudinal vortex is formed. Then, this longitudinal vortex suppresses the separation of the flow along the blade surface, and thus the noise during air blowing can be reduced.

Further, for example, in Patent Literature 3, there is disclosed a turbofan in which a ridge direction of the blade is substantially parallel to the axial direction, and a plurality of corner portions are formed in the leading edge of the blade. The leading edge of the blade is formed into such a stepped shape that the leading edge is positioned forward in the rotational direction toward the hub side.

In the turbofan configured as described above, the flow turbulence is caused through collision with the corner portions, to thereby generate two longitudinal vortices. The vortices suppress the separation. Thus, the air blowing noise can be reduced, and the air blowing efficiency can be improved.

CITATION LIST

Patent Literature

[PTL 1] JP 4612084 B (mainly FIG. 4)
[PTL 2] JP 3649157 B (FIGS. 3, 4, 8, 9, etc.)
[PTL 3] JP 3391319 B (mainly FIG. 3)

SUMMARY OF INVENTION

Technical Problem

However, in the above-mentioned related-art turbofans, the following problems arise. First, in the turbofan disclosed in Patent Literature 1, the leading edge section of the blade is inclined forward so that the shroud side is positioned on the forward side in the rotational direction with respect to the main plate side. However, the entire blade is inclined on the rotational direction side, and hence, when the suction flow is directed on the downstream side, the air is liable to flow to the main plate side, to thereby cause separation in the vicinity of the trailing edge section of the blade on the shroud side. Thus, non-uniform air velocity distribution is caused due to turbulence and generation of a low air velocity region.

Further, even when the airflow rate is lower than the design point, the separation vortex can be divided into two vortices with the concave-shaped portion formed at the center position in the height direction and the convex-shaped portions respectively formed on the shroud side and on the main plate side. However, the separation vortex cannot be suppressed, and hence there is a problem in that the effect of reducing noise is small.

Further, in the turbofan disclosed in Patent Literature 2, the flow collides with the discontinuous surface of the blade so as to form the longitudinal vortex, which suppresses separation. However, the longitudinal vortex is present, and hence there is a problem in that the effect of reducing noise is small.

Further, in the mode configured so that the chord length of the blade is changed so as to increase from the stepped surface toward the hub, the amount of work increases toward the hub side, and hence the flow concentrates on the hub side. Thus, there is a risk in that the separation vortex is generated on the opposing shroud side so as to worsen the noise.

Further, in the turbofan disclosed in Patent Literature 3, the plurality of corner portions are formed in the leading edge of the blade, and hence the longitudinal vortex is formed at the corner portion, which suppresses the separation. However, the longitudinal vortex is present, and hence there is a problem in that the effect of reducing noise is small.

The present invention has been made in view of the above-mentioned circumstances, and has an object to provide a turbofan that is capable of suppressing turbulence such as a separation vortex and a longitudinal vortex, and obtaining a larger effect of reducing noise, and to provide an air conditioner having the turbofan installed thereon.

Solution to Problem

In order to achieve the above-mentioned object, according to one embodiment of the present invention, there is provided a turbofan, including: a shroud arranged on a suction side; a main plate arranged to be opposed to the shroud; and a plurality of blades arranged between the shroud and the main plate, the shroud being formed so that a diameter is increased toward the main plate, the main plate having a radially center part that is protruded toward the shroud, the plurality of blades each being formed so that a blade leading edge is positioned closer to a rotational center axis than a blade trailing edge. The blade leading edge includes: an inner peripheral-side leading edge section; a shroud-side leading edge section; and a blade tip section positioned between the inner peripheral-side leading edge section and the shroud-side leading edge section. The inner peripheral-side leading edge section includes: an inner peripheral-side blade leading edge section main plate-side portion; an inner peripheral-side blade leading edge section tip-side portion; a main plate-side blade tip portion; and a main plate-side shoulder surface portion. The inner peripheral-side blade leading edge section main plate-side portion, the main plate-side blade tip portion, the main plate-side shoulder surface portion, and the inner peripheral-side blade leading edge section tip-side portion are formed in the stated order from the main plate toward the shroud. The inner peripheral-side blade leading edge section main plate-side portion is distanced from the blade trailing edge and the rotational center axis as the inner peripheral-side blade leading edge section main plate-side portion is distanced from the main plate. The inner peripheral-side blade leading edge section main plate-side portion is bent in a direction to form a concavity that extends oppositely to the rotational direction. The main plate-side blade tip portion is a convex portion that protrudes forward in the rotational direction. The main plate-side shoulder surface portion is distanced from the rotational center axis while approaching the blade trailing edge as the main plate-side shoulder surface portion is distanced from the main plate-side blade tip portion. The inner peripheral-side blade leading edge section tip-side portion is distanced from the blade trailing edge and the rotational center axis as the inner peripheral-side blade leading edge section tip-side portion is distanced from the main plate.

Advantageous Effects of Invention

According to one embodiment of the present invention, it is possible to suppress the turbulence such as the separation vortex and the longitudinal vortex, and obtain the larger effect of reducing noise.

DESCRIPTION OF EMBODIMENTS

Figure 1:
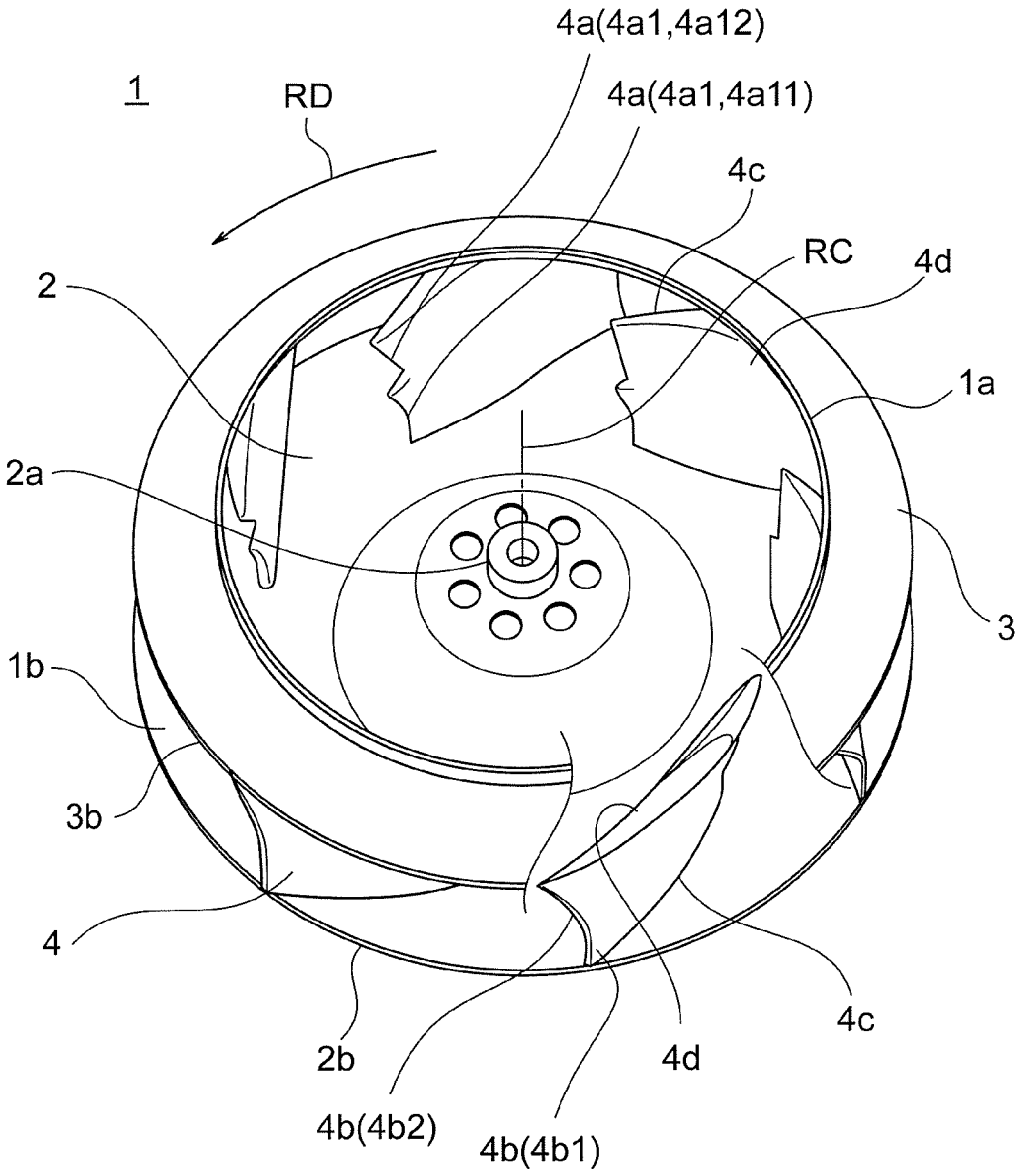
FIG. 1 is a perspective view schematically illustrating a turbofan according to a first embodiment of the present invention.

Now, embodiments of the present invention are described with reference to the accompanying drawings. Note that, in the drawings, the same reference symbols represent the same or corresponding parts.

First Embodiment

Figure 2:
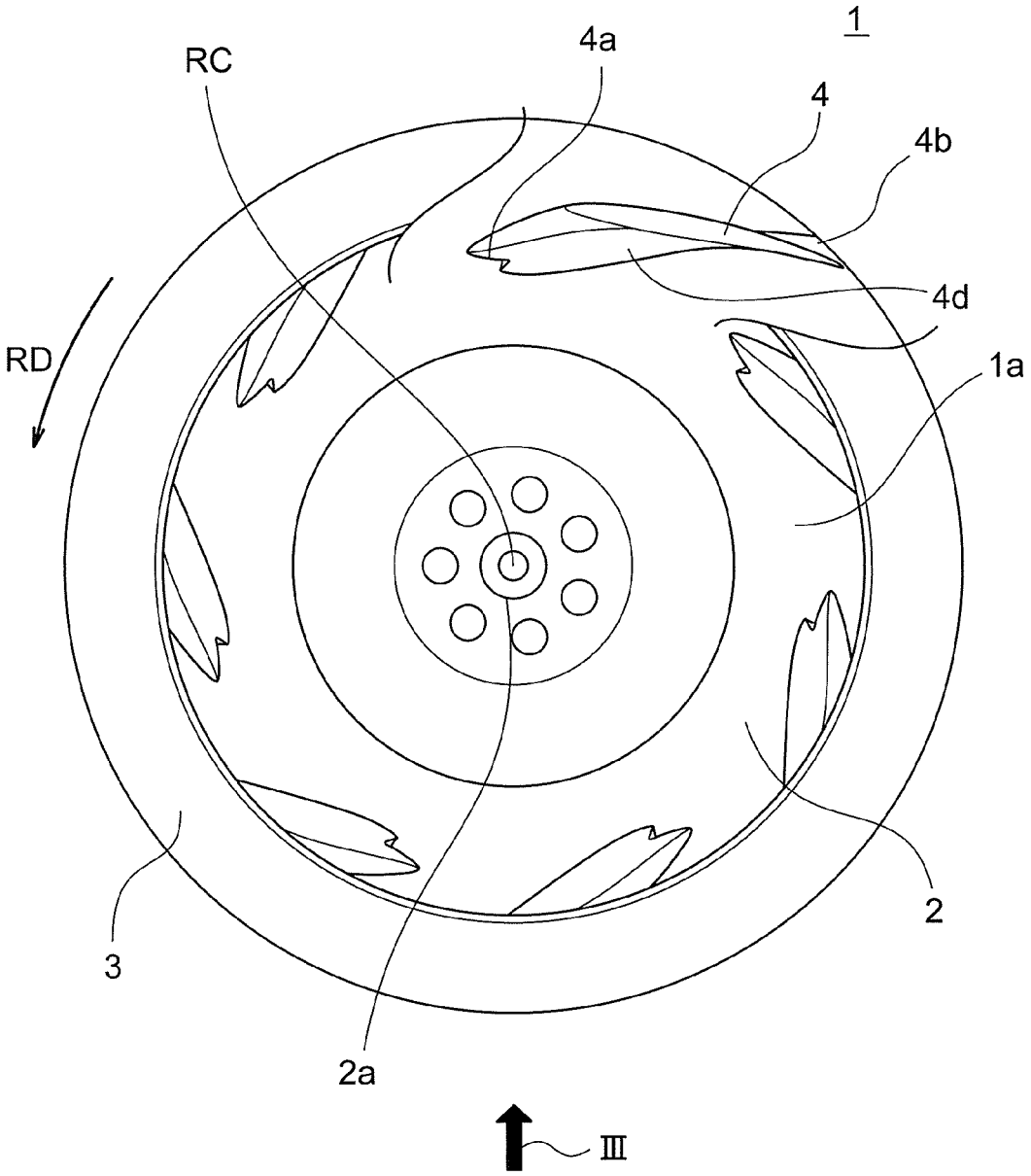
FIG. 2 is a plan view schematically illustrating the turbofan according to the first embodiment.
Figure 3:
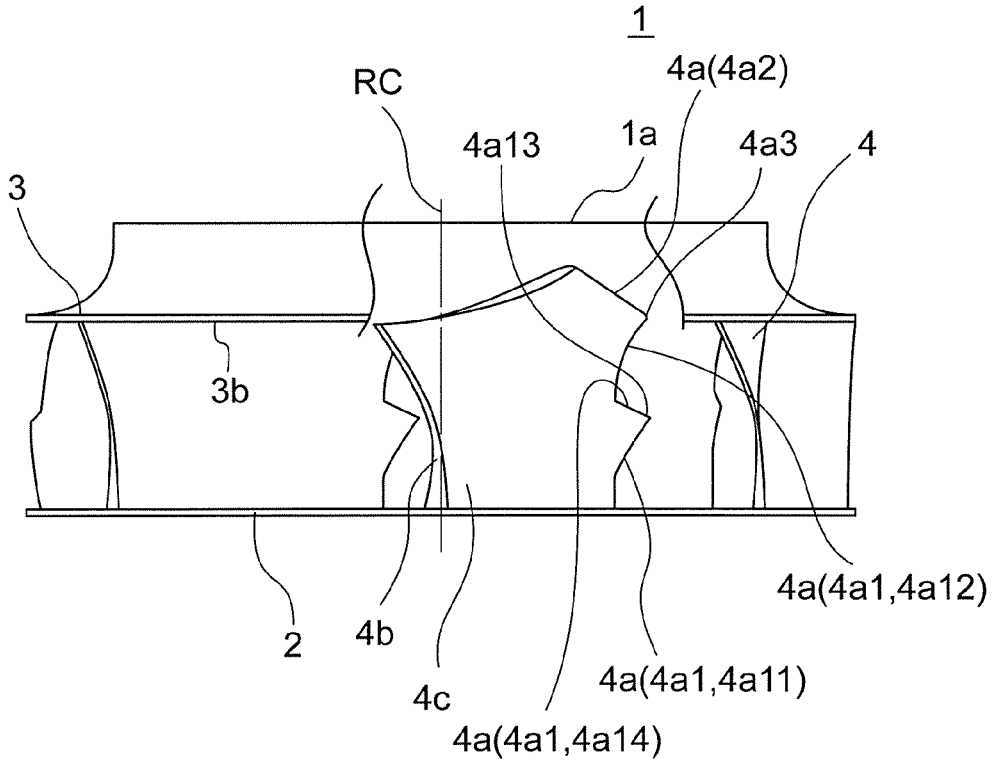
FIG. 3 is a partial sectional side view illustrating the turbofan according to the first embodiment when viewed from the arrow III of FIG. 2.
Figure 4:
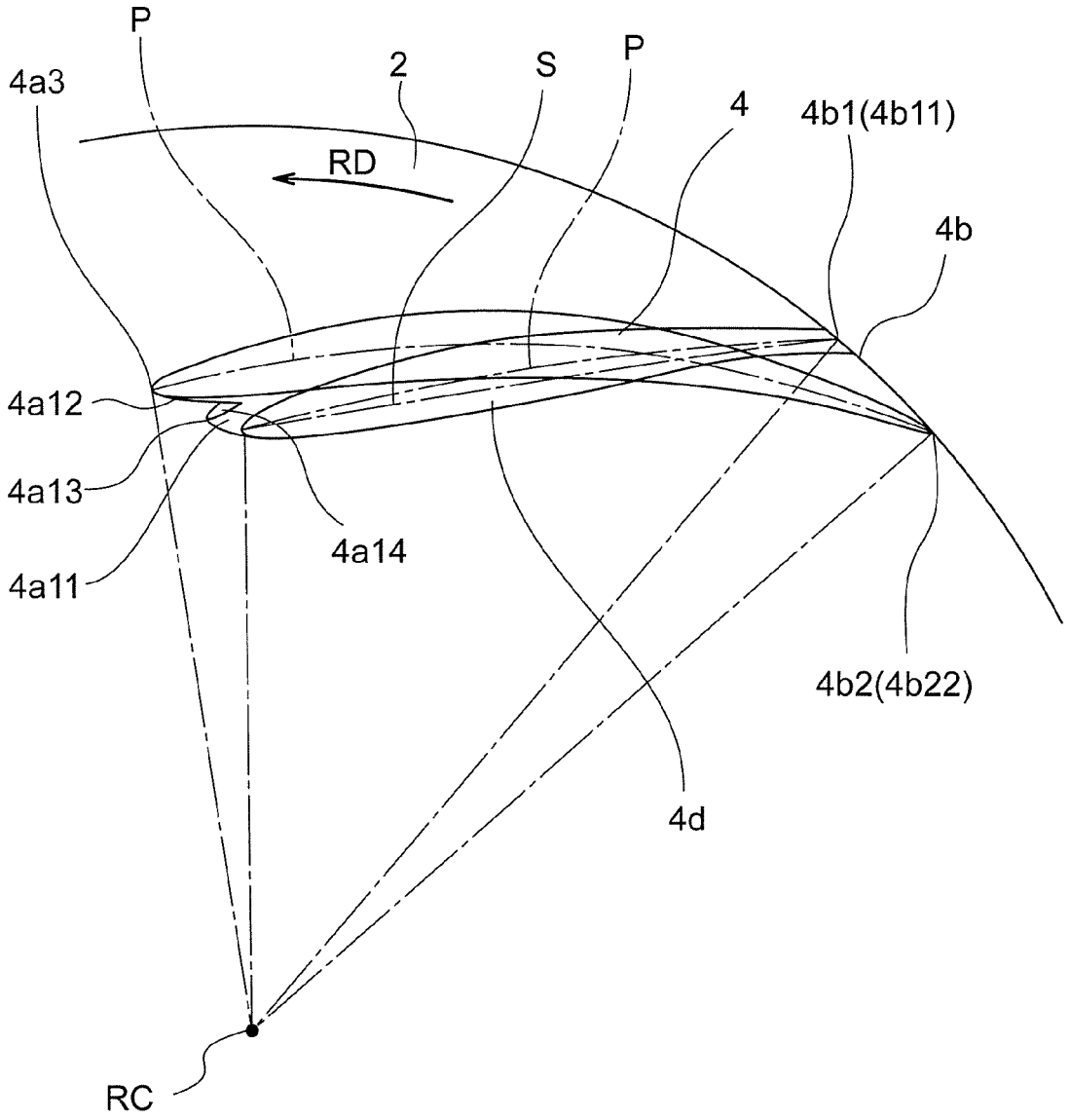
FIG. 4 is a plan view illustrating a single blade of the turbofan according to the first embodiment.

FIGS. 1 and 2 are a perspective view and a plan view, respectively, schematically illustrating a turbofan according to a first embodiment of the present invention. FIG. 3 is a partial sectional side view illustrating the turbofan according to the first embodiment when viewed from the arrow III of FIG. 2. FIG. 4 is a plan view illustrating a single blade of the turbofan according to the first embodiment. Reference symbol RD in FIG. 1 represents a rotational direction of the turbofan.

Figure 5:
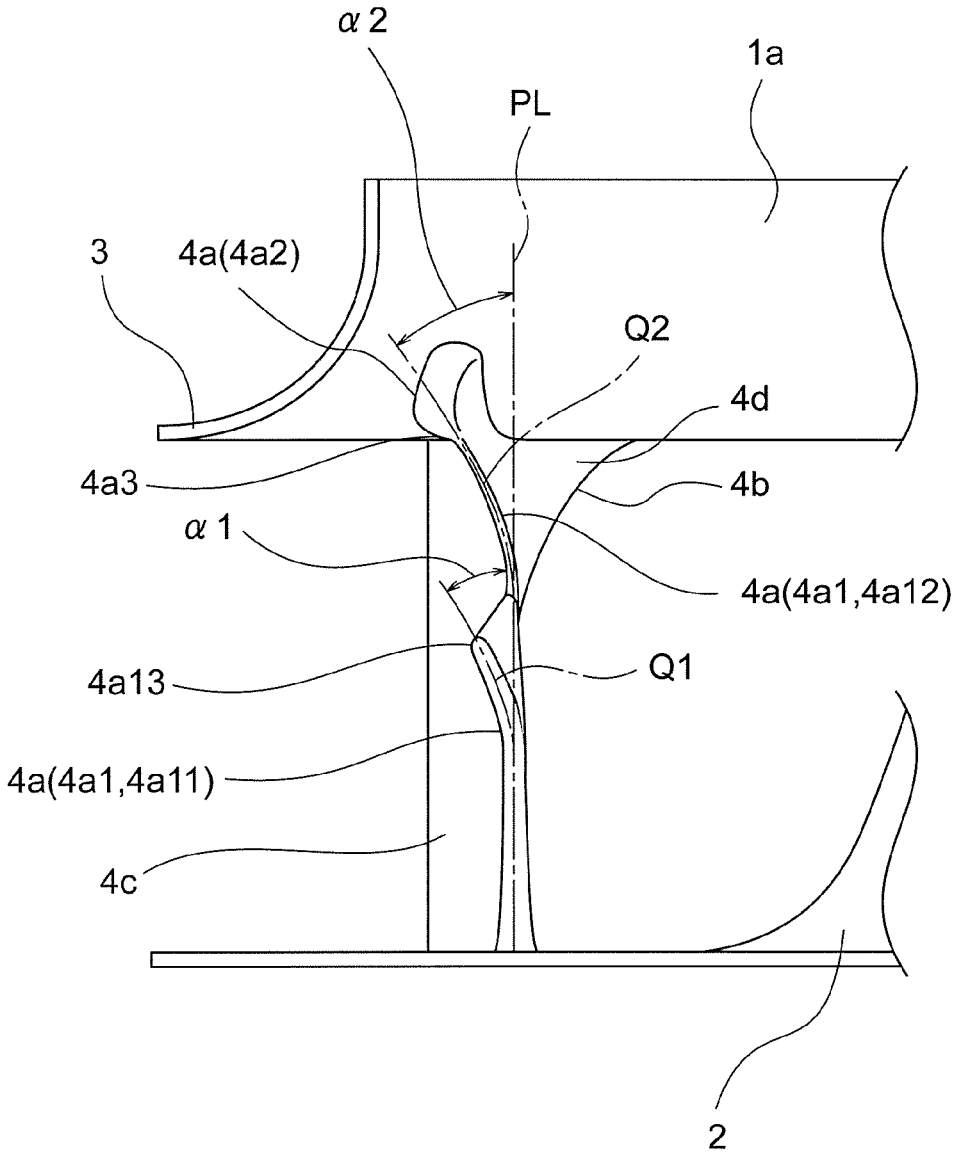
FIG. 5 is a view illustrating a blade leading edge section of the turbofan according to the first embodiment when viewed from a fan inner peripheral side.
Figure 6:
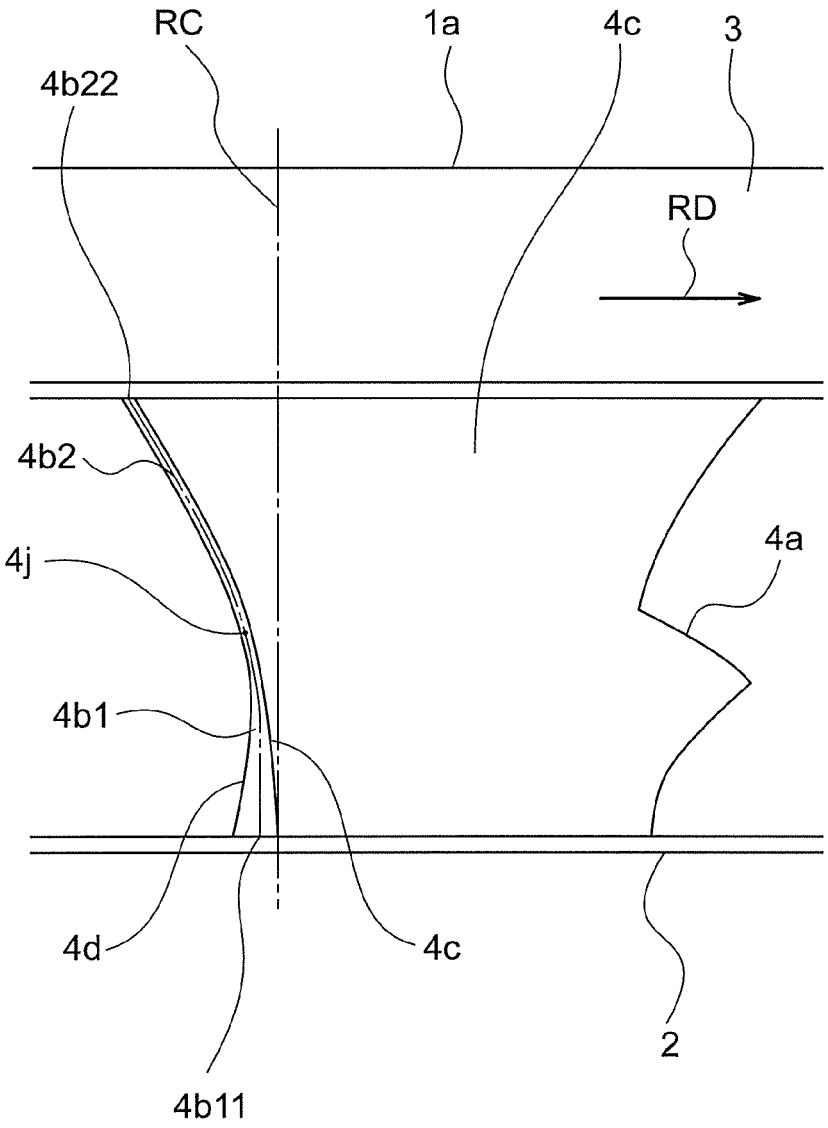
FIG. 6 is a side view illustrating a blade trailing edge section of the turbofan according to the first embodiment.

Note that, in the following, the turbofan to be installed in an air conditioner (second embodiment to be described later) is described, but the present invention is not limited thereto. The present invention may be employed as other blower means for various air conditioners or various apparatus. Further, for easy understanding of the description, the front surface of the drawing sheet of FIG. 2 and the upper side of the drawing sheets of FIGS. 3, 5, and 6 are set as a suction side (room side for installation in a ceiling-concealed mode to be described later). In the case of the air conditioner according to the second embodiment to be described later, such a state where a main body top plate of a conditioner main body is placed on an arbitrary floor, and an air inlet of the main body is directed upward is assumed.

A turbofan 1 includes a main plate 2 that is a rotator having a center protruded into a mountain shape, a substantially annular shroud 3 opposed to the main plate 2, and a plurality of blades 4 arranged between the main plate 2 and the shroud 3. Each of the plurality of blades 4 has one end side joined to the main plate 2 and the other end side joined to the shroud 3.

The main plate 2 has a circular shape when viewed in a projection manner along a rotational axis of the turbofan 1. A radially center part of the main plate 2 is protruded into a mountain shape toward the shroud 3. Further, in a part of the main plate 2 on the radially outer side, that is, an annular part around the protruded radially center part is formed into a substantially flat plate shape.

At the center portion of the main plate 2 (top of the mountain-shaped protrusion), a boss 2*a* is mounted, and this boss 2*a* is fixed to a rotary shaft of a fan motor to be described later.

The shroud 3 forms a fan air inlet 1*a* on the opposite side to the main plate 2, and has a curve that swells toward the radially inner side so that the diameter increases from the fan air inlet 1*a* toward the main plate 2. An annular end rim of the shroud 3 on the main plate 2 side (hereinafter referred to as "shroud outer periphery 3*b*") has the largest diameter, and a region sandwiched between the shroud outer periphery 3*b* and an outermost annular end rim of the main plate 2 (hereinafter referred to as "main plate outer periphery 2*b*") functions as a fan air outlet 1*b*.

Each of the plurality of blades 4 is formed so that a blade leading edge 4*a* is positioned closer to a rotational center axis RC than a blade trailing edge 4*b*. Each of the blade leading edges 4*a* is positioned at a predetermined distance from the rotational center axis RC, and each of the blade trailing edges 4*b* is positioned in the vicinity of the shroud outer periphery 3*b* and the main plate outer periphery 2*b*. An extended line of a virtual line connecting the blade leading edge 4*a* and the blade trailing edge 4*b* (hereinafter referred to as "chord line") extends so as not to pass through the rotational center axis RC. That is, the blade leading edge 4*a* is positioned forward in the rotational direction RD with respect to a radius line connecting the rotational center axis RC and the blade trailing edge 4*b*. Further, the plurality of blades 4 are formed point symmetrical about the rotational center axis RC.

Further, in the blade 4, a blade outer surface (corresponding to a positive pressure surface) 4*c*, which is a surface farther from the rotational center axis RC, is positioned so as to be distanced from the rotational center axis RC toward the rear side in the rotational direction RD. Further, a blade inner surface (corresponding to a negative pressure surface) 4*d* of the blade 4, which is a surface closer to the rotational center axis RC, is similarly positioned so as to be distanced from the rotational center axis RC toward the rear side in the rotational direction RD with a predetermined interval (corresponding to the thickness of the blade 4) from the blade outer surface 4*c*. Further, the above-mentioned predetermined interval (corresponding to the thickness of the blade 4) is increased at a center part between the blade leading edge 4*a* and the blade trailing edge 4*b*, and is gradually decreased toward the blade leading edge 4*a* and the blade trailing edge 4*b*. That is, the lateral cross section is approximated to a wing shape.

Note that, in a plane parallel to the flat plate part of the main plate 2 (plane having the rotational center axis RC as a normal), a line representing a center position between the blade outer surface 4*c* and the blade inner surface 4*d* is referred to as "horizontal camber line P", and a straight line connecting the end point of the blade leading edge 4*a* and the end point of the blade trailing edge 4*b* is referred to as "horizontal chord line S".

Next, the blade leading edge is described. As is best illustrated in FIG. 3, the blade leading edge 4*a* of the blade 4 includes an inner peripheral-side leading edge section 4*a*1 formed on the fan inner peripheral side, a shroud-side leading edge section 4*a*2 facing the fan air inlet 1*a*, and a blade tip section 4*a*3. The inner peripheral-side leading edge section 4*a*1 and the shroud-side leading edge section 4*a*2 intersect with each other at the blade tip section 4*a*3.

As is best illustrated in FIGS. 3 and 4, the inner peripheral-side leading edge section 4*a*1 includes an inner peripheral-side blade leading edge section main plate-side portion 4*a*11, an inner peripheral-side blade leading edge section tip-side portion 4*a*12, a main plate-side blade tip portion 4*a*13, and a main plate-side shoulder surface portion 4*a*14. The inner peripheral-side blade leading edge section main plate-side portion 4*a*11, the main plate-side blade tip portion 4*a*13, the main plate-side shoulder surface portion 4*a*14, and the inner peripheral-side blade leading edge section tip-side portion 4*a*12 are positioned in the stated order in a range from the main plate 2 toward the blade tip section 4*a*3.

The inner peripheral-side blade leading edge section main plate-side portion 4*a*11 is gradually curved so as to be distanced from the blade trailing edge 4*b* and the rotational center axis RC as the inner peripheral-side blade leading edge section main plate-side portion 4*a*11 is distanced from the main plate 2 in the height direction (direction of the rotational center axis RC).

The main plate-side blade tip portion 4*a*13 is present between the inner peripheral-side blade leading edge section main plate-side portion 4*a*11 and the main plate-side shoulder surface portion 4*a*14. The main plate-side shoulder surface portion 4*a*14 is curved so as to be distanced from the rotational center axis RC while approaching the blade trailing edge 4*b* as the main plate-side shoulder surface portion 4*a*14 is distanced from the main plate-side blade tip portion 4*a*13.

The inner peripheral-side blade leading edge section tip-side portion 4*a*12 is gradually curved so as to be distanced from the blade trailing edge 4*b* and the rotational center axis RC as the inner peripheral-side blade leading edge section tip-side portion 4*a*12 is distanced from the main plate 2.

As described above, the blade leading edge 4*a* is inclined so as to be distanced from the rotational center axis RC as the blade leading edge 4*a* is distanced from the main plate 2, and has a zigzag shape (convexoconcave shape) including two convex portions (blade tip section 4*a*3 and main plate-side blade tip portion 4*a*13) that protrude forward in the rotational direction RD of the fan. The inner peripheral-side leading edge section 4*a*1 includes two concave portions (inner peripheral-side blade leading edge section main plate-side portion 4*a*11 and inner peripheral-side blade leading edge section tip-side portion 4*a*12) including curves that protrude rearward in the rotational direction RD of the fan.

Further, as illustrated in FIG. 5, when the inner peripheral-side blade leading edge section main plate-side portion 4*a*11 and the inner peripheral-side blade leading edge section tip-side portion 4*a*12 are viewed from the forward side toward the rearward side in the rotational direction (when viewed in a plane extending in the direction of the rotational center axis RC), regarding the respective inner peripheral-side blade leading edge section main plate-side portion 4*a*11 and inner peripheral-side blade leading edge section tip-side portion 4*a*12, thickness center lines (vertical camber lines), which each correspond to the center of the interval between the blade outer surface 4*c* and the blade inner surface 4*d*, are represented by Q1 and Q2. When a straight line PL parallel to the rotational center axis RC is considered, the thickness center lines Q1 and Q2 match with the straight line PL on the main plate 2 side, and are bent forward in the rotational direction RD from predetermined positions separated from the main plate 2 by predetermined distances so as to separate from the straight line PL, in other words, so that the distance from the straight line PL gradually increases. In the first embodiment, angles (camber angles) $\alpha 1$ and $\alpha 2$ are formed between the straight line PL parallel to the rotational center axis RC and the thickness center lines Q1 and Q2 of the respective inner peripheral-side blade leading edge section main plate-side portion 4a11 and inner peripheral-side blade leading edge section tip-side portion 4a12. Further, the following relationship is satisfied: the angle $\alpha 1$ relating to the inner peripheral-side blade leading edge section main plate-side portion 4a11≥the angle $\alpha 2$ relating to the inner peripheral-side blade leading edge section tip-side portion 4a12.

Next, the blade trailing edge is described. The blade trailing edge 4b is positioned in the vicinity of a virtual cylindrical surface ideated by connecting the main plate outer periphery 2b and the shroud outer periphery 3b to each other. The blade trailing edge 4b includes, with a point of curvature 4j as a boundary, a main plate-side blade trailing edge 4b1 and a shroud-side blade trailing edge 4b2. The point of curvature 4j is positioned at a predetermined height from the main plate 2 toward the shroud 3. The main plate-side blade trailing edge 4b1 is positioned on the main plate 2 side with respect to the point of curvature 4j, and the shroud-side blade trailing edge 4b2 is positioned on the shroud 3 side with respect to the point of curvature 4j.

The blade outer surface 4c side of the main plate-side blade trailing edge 4b1 is inclined rearward in the rotational direction until the point of curvature 4j as the blade outer surface 4c side is distanced from the main plate 2, and the blade inner surface 4d side of the main plate-side blade trailing edge 4b1 is inclined forward in the rotational direction RD until the point of curvature 4j as the blade inner surface 4d side is distanced from the main plate 2. With this, the thickness of the main plate-side blade trailing edge 4b1 is gradually reduced (thinned) until the point of curvature 4j from a main plate-side trailing edge end point 4b22.

Further, the shroud-side blade trailing edge 4b2 is inclined rearward in the rotational direction both in the blade outer surface 4c and the blade inner surface 4d, and is connected to the shroud 3 at a shroud-side trailing edge end point 4b22.

As illustrated in FIGS. 4 and 6, the shroud-side blade trailing edge 4b2 is inclined from the main plate 2 to the shroud 3 so as to be distanced from the blade leading edge 4a and positioned rearward in the rotational direction as the shroud-side blade trailing edge 4b2 is distanced from the main plate 2. In particular, the blade outer surface 4c of the shroud-side blade trailing edge 4b2 is inclined rearward in the rotational direction RD more on the shroud side as compared to the main plate side, and is inclined rearward in the rotational direction RD from the main plate to the shroud so as to be gradually distanced from the blade leading edge as the blade outer surface 4c is distanced from the main plate.

According to the turbofan of the first embodiment configured as described above, excellent advantages can be obtained as follows.

First, in the first embodiment, the blade leading edge 4a of the blade 4 includes the inner peripheral-side leading edge section 4a1, the shroud-side leading edge section 4a2, and the blade tip section 4a3. The inner peripheral-side leading edge section 4a1 includes the inner peripheral-side blade leading edge section main plate-side portion 4a11, the inner peripheral-side blade leading edge section tip-side portion 4a12, the main plate-side blade tip portion 4a13, and the main plate-side shoulder surface portion 4a14. The inner peripheral-side blade leading edge section main plate-side portion 4a11 is gradually curved to be distanced from the blade trailing edge 4b and the rotational center axis RC as the inner peripheral-side blade leading edge section main plate-side portion 4a11 is distanced from the main plate 2 in the height direction (direction of the rotational center axis RC). The entire inner peripheral-side blade leading edge section main plate-side portion 4a11 is curved along a curved surface that is bent in a direction to form a concavity that extends oppositely to the rotational direction RD of the fan. Further, the main plate-side shoulder surface portion 4a14 is curved to be distanced from the rotational center axis RC while approaching the blade trailing edge 4b as the main plate-side shoulder surface portion 4a14 is distanced from the main plate-side blade tip portion 4a13. Note that, as one point of view, at the shroud-side leading edge section 4a2 and the inner peripheral-side blade leading edge section tip-side portion 4a12, the flow is turned toward the fan air outlet side. Therefore, the flow from the inner peripheral-side blade leading edge section main plate-side portion 4a11 is assumed to become unstable toward the blade trailing edge 4b. However, in the first embodiment, the inner peripheral-side blade leading edge section main plate-side portion 4a11 is formed into a curved shape as described above. Therefore, the flow in the vicinity of the hub (radially center part of the main plate 2, which is protruded into a mountain shape toward the shroud 3) can be collected toward the blade outer surface 4c. Thus, the flow becomes stable, and can be actively induced again as compared to the shape in which the blade is uniformly inclined. Further, the inner peripheral-side blade leading edge section main plate-side portion 4a11 is formed into a curved shape as described above, and hence no separation vortex is generated at the blade inner surface 4d. Therefore, the collision of the flow during inflow can be suppressed, and the turbulence can be reduced.

Further, the blade leading edge 4a has a zigzag shape (convexoconcave shape) including the two convex portions (blade tip section 4a3 and main plate-side blade tip portion 4a13) that protrude forward in the rotational direction RD of the fan, and the inner peripheral-side leading edge section 4a1 includes the two concave portions (inner peripheral-side blade leading edge section main plate-side portion 4a11 and inner peripheral-side blade leading edge section tip-side portion 4a12) including curves that protrude rearward in the rotational direction RD of the fan. Therefore, as compared to a mode in which the convex portion is present only in a part corresponding to the blade tip section 4a3, a separation vortex, which is generated from a flow flowing toward the inner peripheral-side blade leading edge section tip-side portion 4a12 as the flow is directed toward the main plate, reaches the inner peripheral-side blade leading edge section main plate-side portion 4a11 before being developed. Therefore, development of the separation vortex is suppressed, and the inflow toward the main plate side is not inhibited. Therefore, a turning part (half of the flow on the shroud 3 side of a wing 5) and a radial part (half of the flow on the main plate 2 side of the wing 5) are formed in the flow, and both of the flow in the turning part and the flow in the radial part are smoothly joined, to thereby suppress turbulence.

As described above, according to the first embodiment, the separation at the blade surface can be prevented, the collision of the flow can be suppressed, and a uniform air velocity distribution can be obtained. Therefore, a local high-velocity region is eliminated, which can reduce the noise and maintain the air blowing efficiency. In this manner, a quiet and energy-saving turbofan (and an air conditioner having the turbofan installed thereon) can be obtained.

Further, when viewed in a plane orthogonal to the rotational center axis RC, the main plate-side blade tip portion 4a13 and the blade tip section 4a3 are positioned so that the blade tip section 4a3 is positioned more forward in the rotational direction RD of the fan. Therefore, in the air flowing through the fan air inlet, the air closer to the wall surface of the shroud 3 flows in toward the inner peripheral-side blade leading edge section tip-side portion 4*a*12, and the air flowing in closer to the boss 2*a*, which is a substantially center convex portion of the main plate 2, flows in from the inner peripheral-side blade leading edge section main plate-side portion 4*a*11. Thus, the interference of scrambling for the suction flow is suppressed, and hence the flow becomes stable. Even with this, the separation can be suppressed. As a result, the low-noise turbofan (and the air conditioner having the turbofan installed thereon) can be obtained.

Further, in the inner peripheral-side blade leading edge section main plate-side portion 4*a*11 and the inner peripheral-side blade leading edge section tip-side portion 4*a*12, the thickness center lines Q1 and Q2, which are each positioned between the blade outer surface 4*c* and the blade inner surface 4*d*, are bent forward in the rotational direction RD so that, in a plane parallel to the rotational center axis RC, the angles $\alpha 1$ and $\alpha 2$ formed between the straight line PL parallel to the rotational center axis RC and the thickness center lines Q1 and Q2 are gradually increased from the predetermined positions from the main plate. Therefore, unlike the case where the entire blade is inclined in the rotational direction as in the related art, when the suction flow passes along the blade inner surface so as to be directed to the downstream side, the flow does not concentrate on the main plate side, and hence the separation can be prevented at the shroud-side blade trailing edge section. Further, a local high-velocity region can be suppressed, and hence a uniform air velocity distribution can be obtained. Further, the air flowing in toward the blade outer surface can be gradually caused to flow in, and hence, as compared to the case where the entire blade is inclined, the wind pressure and the frictional resistance can be reduced. As a result, a low-noise turbofan with high air blowing efficiency can be obtained. Further, as a result, the power consumption of the motor can be reduced, and thus a low-noise and power-saving air conditioner can be obtained.

Further, the inner peripheral-side leading edge section 4*a*1 is formed so as to satisfy the following relationship: the above-mentioned angle $\alpha 1$ relating to the inner peripheral-side blade leading edge section main plate-side portion 4*a*11 the above-mentioned angle $\alpha 2$ relating to the inner peripheral-side blade leading edge section tip-side portion 4*a*12. Therefore, even when an effective suction flow path toward the main plate side of the blade leading edge is narrowed due to the hub, the flow inducing effect can be increased by increasing the angle $\alpha 1$ on the main plate side. Further, the angles satisfy $\alpha 1 \geq \alpha 2$ as described above, and hence even when the air flowing in toward the inner peripheral-side blade leading edge section tip-side portion 4*a*12 to be turned to the air outlet side is increased, the suction flow toward the main plate side can be secured. Therefore, the suction airflow rate can be increased as a whole, and the turbulence can be suppressed without causing an unstable flow in the vicinity of the center of the blade in the rotational center axis RC direction. As a result, a lower-noise turbofan with high air blowing efficiency can be obtained, in which the airflow rate reduction is small even when the airflow resistance increases on the suction side. Further, as a result, a low-noise, energy-saving, and high-reliability air conditioner that is capable of reducing the power consumption of the motor can be obtained.

The blade trailing edge 4*b* is positioned on the virtual cylindrical surface formed by the main plate outer periphery and the shroud outer periphery, and includes the main plate-side blade trailing edge 4*b*1, the shroud-side blade trailing edge 4*b*2, and the point of curvature 4*j*. The point of curvature 4*j* is positioned at the boundary between the main plate-side blade trailing edge 4*b*1 and the shroud-side blade trailing edge 4*b*2. The main plate-side blade trailing edge 4*b*1 is positioned on the main plate 2 side with respect to the point of curvature 4*j*, and the shroud-side blade trailing edge 4*b*2 is positioned on the shroud 3 side with respect to the point of curvature 4*j*. The blade outer surface 4*c* side of the main plate-side blade trailing edge 4*b*1 until the point of curvature 4*j* is inclined rearward in the rotational direction as the blade outer surface 4*c* is distanced from the main plate 2, and the blade inner surface 4*d* side of the main plate-side blade trailing edge 4*b*1 until the point of curvature 4*j* is inclined forward in the rotational direction RD as the blade inner surface 4*d* is distanced from the main plate 2, so that the thickness of the main plate-side blade trailing edge 4*b*1 is gradually reduced from the main plate-side trailing edge end point 4*b*11 to the point of curvature 4*j*. The shroud-side blade trailing edge 4*b*2 is inclined rearward in the rotational direction both in the blade outer surface 4*c* and the blade inner surface 4*d*, and is connected to the shroud 3 at the shroud-side trailing edge endpoint 4*b*22. The blade outer surface 4*c* of the shroud-side blade trailing edge 4*b*2 is inclined rearward in the rotational direction RD more on the shroud side as compared to the main plate side, and is inclined rearward in the rotational direction RD from the main plate to the shroud so as to be gradually distanced from the blade leading edge as the blade outer surface 4*c* is distanced from the main plate. With this, in the main plate-side blade trailing edge 4*b*1, the blade outer surface is inclined, and hence the flow is dispersed toward the shroud side without concentrating on the main plate side. The shroud side is further retreated from the point of curvature, and hence the turned flow from the air inlet becomes the main flow, and the dispersed flow on the main plate side and the main flow smoothly join with each other without collision. Further, in order to cope with such a slip phenomenon that the flow along the blade inner surface is guided by the blown-out flow from the blade outer surface, the blade inner surface is inclined in the rotational direction as the blade inner surface is distanced from the main plate, to thereby gradually increase the thickness toward the main plate. Therefore, the air flows along the blade trailing edge, and hence the separation can be suppressed. Further, in the shroud-side blade trailing edge 4*b*2, when the air flowing in through the fan air inlet toward the inner peripheral-side blade leading edge section tip-side portion 4*a*12 and the shroud-side leading edge section 4*a*2 is turned toward the fan air outlet, because the shroud side of the blade trailing edge is inclined in a direction opposite to the rotational direction as compared to the main plate side, the flow that attempts to move toward the main plate after being turned can be further induced toward the shroud side. Therefore, separation can be suppressed in the vicinity of the shroud.

Second Embodiment

Figure 7:
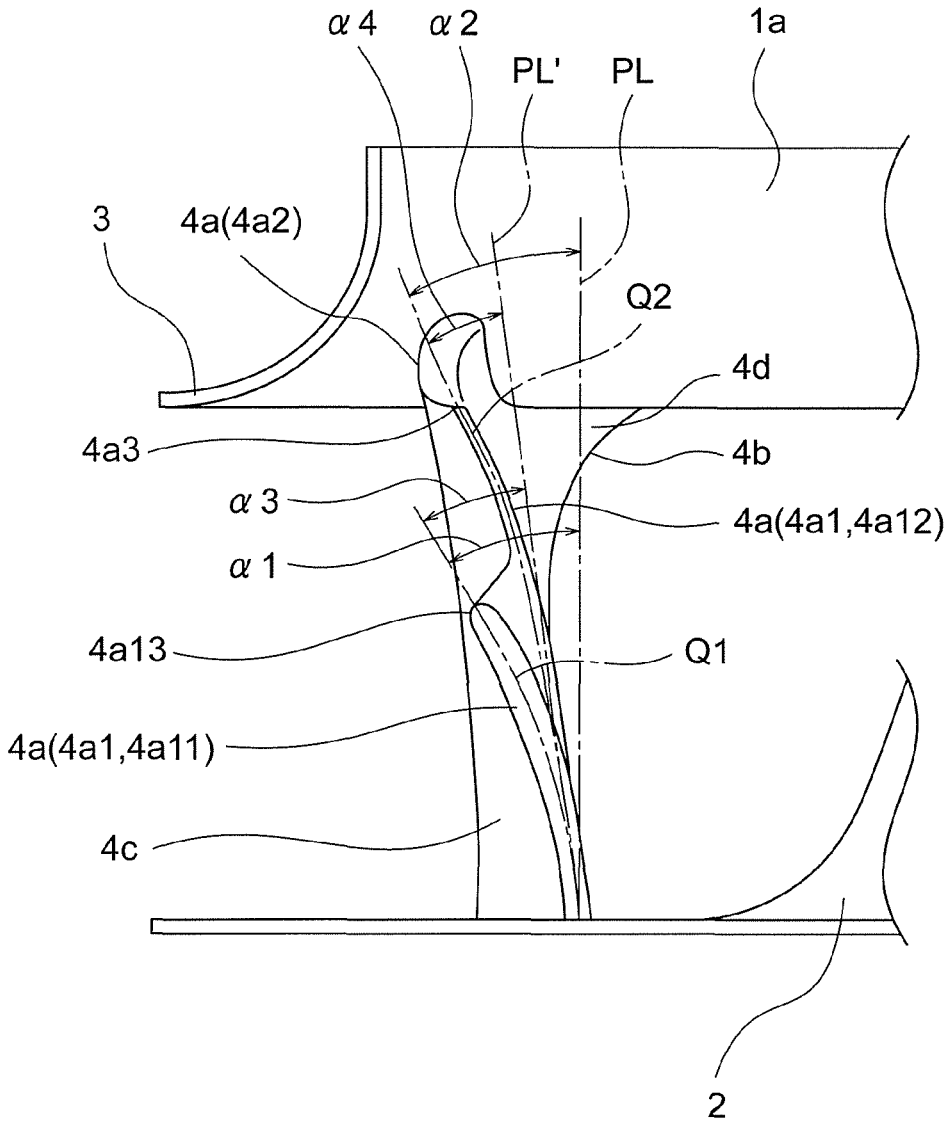
FIG. 7 is a view illustrating a second embodiment of the present invention in the same manner as that of FIG. 5.

Next, with reference to FIG. 7, a second embodiment of the present invention is described. FIG. 7 is a view illustrating the second embodiment in the same manner as that of FIG. 5. Note that, the second embodiment is the same as the above-mentioned first embodiment except for the parts described below.

In the second embodiment, the entire blade leading edge 4*a* of the blade 4 is configured to further tilt in a direction to separate from the straight line PL as compared to the case of the above-mentioned first embodiment. That is, in the above-mentioned first embodiment, the thickness center lines Q1 and Q2 match with the straight line PL on the main plate 2 side, and are bent from the predetermined positions separated from the main plate 2 by the predetermined distances so as to separate from the straight line PL. In contrast, the second embodiment refers to a mode in which a straight line PL' itself, which is a reference representing the degree of tilting of the thickness center lines Q1 and Q2, is inclined with respect to the straight line PL.

That is, in the second embodiment, the thickness center lines Q1 and Q2 match with the straight line PL' on the main plate 2 side, and are bent so as to separate from the straight line PL' from the predetermined positions separated from the main plate 2 by the predetermined distances. Further, the straight line PL' is also inclined with respect to the straight line PL so as to separate from the straight line PL as the straight line PL' is distanced from the main plate 2. Therefore, in the second embodiment, when the inner peripheral-side blade leading edge section main plate-side portion 4*a*11 and the inner peripheral-side blade leading edge section tip-side portion 4*a*12 are viewed from the forward side toward the rearward side in the rotational direction, the angles α1 and α2 are formed between the straight line PL parallel to the rotational center axis RC and the thickness center lines Q1 and Q2 of the respective inner peripheral-side blade leading edge section main plate-side portion 4*a*11 and inner peripheral-side blade leading edge section tip-side portion 4*a*12. In addition, angles α3 and α4 are also formed between the straight line PL' inclined with respect to the straight line PL and the thickness center lines Q1 and Q2.

Also in the second embodiment described above, the actions due to the presence of the angles α1 and α2 are obtained similarly to the first embodiment, and advantages similar to those of the above-mentioned first embodiment can be obtained.

Third Embodiment

Figure 8:
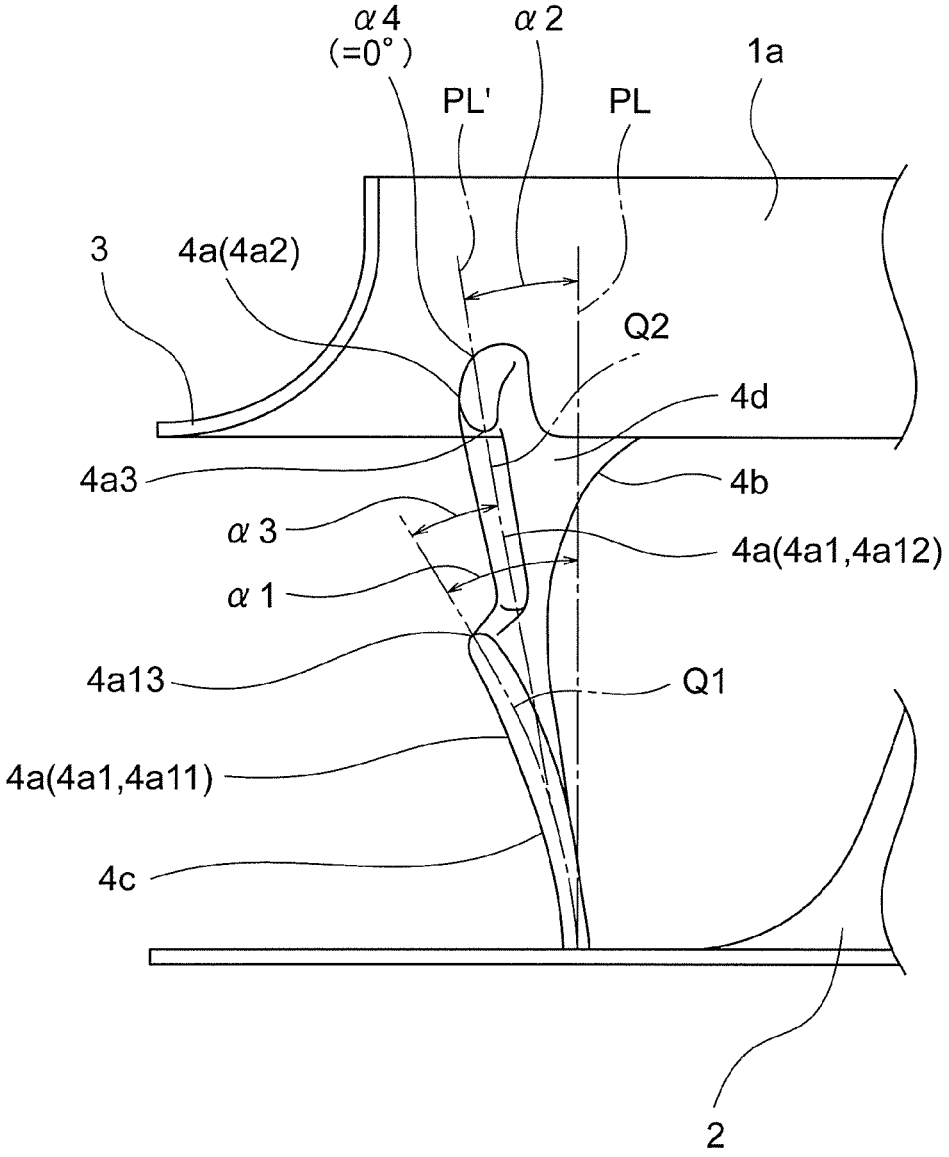
FIG. 8 is a view illustrating a third embodiment of the present invention in the same manner as that of FIG. 5.

Next, with reference to FIG. 8, an eighth embodiment of the present invention is described. FIG. 8 is a view illustrating a third embodiment in the same manner as that of FIG. 5. Note that, the third embodiment is the same as the above-mentioned second embodiment except for the parts described below.

The third embodiment refers to a mode in which the angle α4 relating to the inner peripheral-side blade leading edge section tip-side portion 4*a*12 is absent in the above-mentioned second embodiment (angle α4=0 degree). That is, the thickness center line Q1 relating to the inner peripheral-side blade leading edge section main plate-side portion 4*a*11 is bent from the predetermined position separated from the main plate 2 by the predetermined distance so as to separate from the straight line PL', while the thickness center line Q2 relating to the inner peripheral-side blade leading edge section tip-side portion 4*a*12 matches with the straight line PL'.

Also in the third embodiment described above, the angles α1 and α2 with respect to the straight line PL are present. In this manner, advantages similar to those of the above-mentioned first embodiment can be obtained.

Fourth Embodiment

Figure 9:
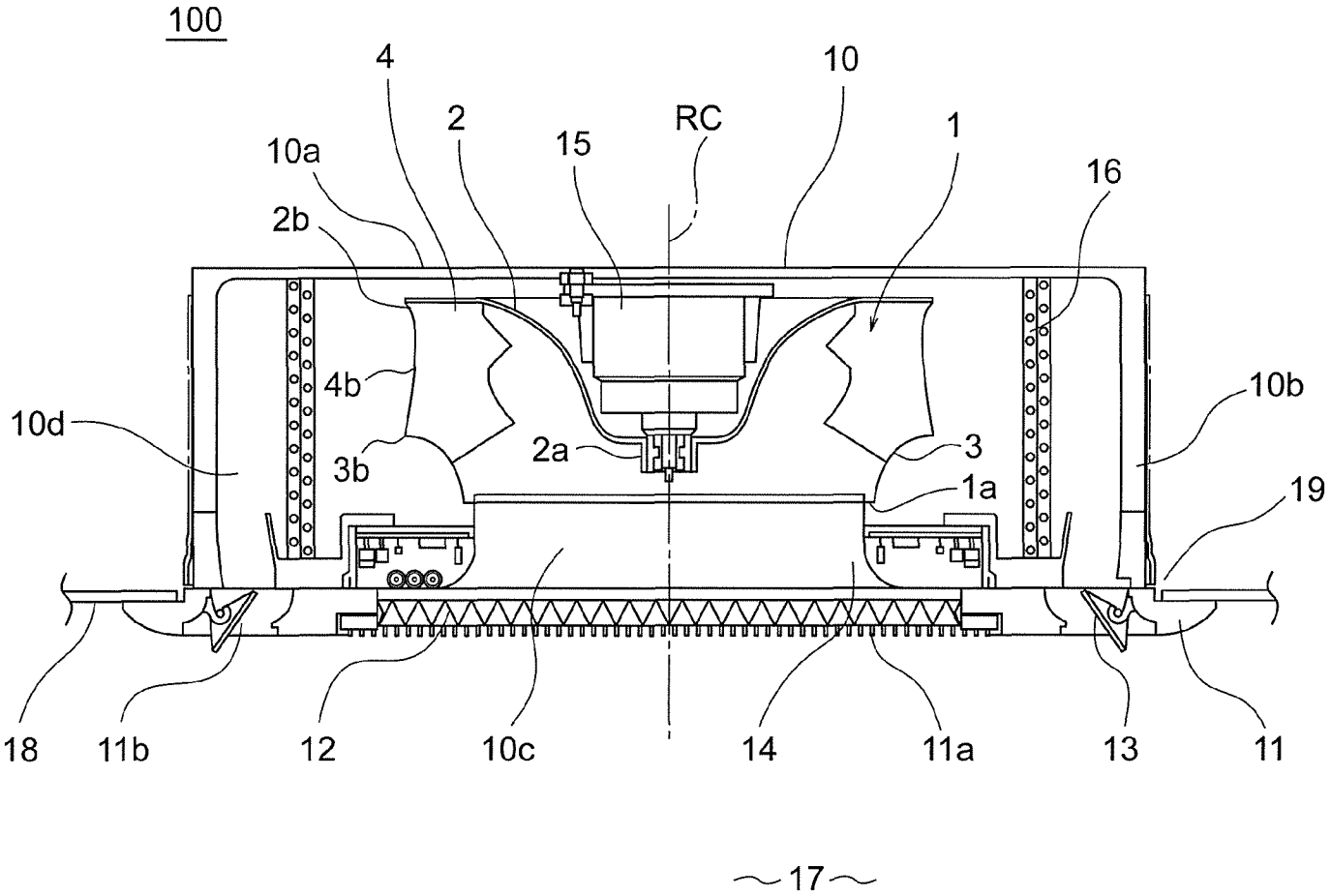
FIG. 9 is a vertical sectional view schematically illustrating an air conditioner according to a fourth embodiment of the present invention.

FIG. 9 is a vertical sectional view schematically illustrating an air conditioner according to a fourth embodiment of the present invention. In FIG. 9, a ceiling-concealed air conditioner 100 is fitted into an opening (including a concave portion) 19 formed in a ceiling surface 18 of a room 17, and includes an air conditioner main body 10, and the turbofan 1 and a heat exchanger (air conditioning unit) 16 housed in the air conditioner main body 10. The turbofan 1 refers to the turbofan according to any one of the above-mentioned first to third embodiments.

The air conditioner main body 10 is a casing formed of a main body side plate 10*b* whose lateral cross section forms a rectangular tubular body, and a main body top plate 10*a* made of a rectangular plate material, for closing one end surface (casing upper part) of the tubular body. On the opening port of the casing (surface opposed to the main body top plate 10*a*, that is, the casing lower part), a decorative panel 11 is mounted in a freely removable manner. That is, the main body top plate 10*a* is positioned above the ceiling surface 18, and the decorative panel 11 is positioned so as to be substantially flush with the ceiling surface 18.

In the vicinity of the center of the decorative panel 11, a suction grille 11*a* is formed as an inlet of air into the air conditioner main body 10. A filter 12 for removing dust in the air passing through the suction grille 11*a* is arranged on the suction grille 11*a*.

On the other hand, on the outer side of the suction grille 11*a* in the decorative panel 11, a panel air outlet 11*b* that is an outlet of air is formed along each side of the decorative panel 11, that is, so as to surround the suction grille 11*a*. At the panel air outlet 11*b*, an airflow-direction vane 13 for adjusting the direction of the air to be blown out is installed.

At the center in the lower surface of the main body top plate 10*a*, a fan motor 15 is installed, and on the rotational center axis RC of the fan motor 15, the turbofan 1 is installed. A bellmouth 14 is arranged between the suction grille 11*a* and the turbofan 1 so as to form a suction air path extending from the suction grille 11*a* toward the turbofan 1.

On the outer side of the turbofan 1, the heat exchanger 16 is arranged. The heat exchanger 16 is configured so as to surround the outer peripheral side of the turbofan 1 (for example, a substantially C-shape in plan view). The heat exchanger 16 includes fins arranged substantially horizontally at predetermined intervals, and heat transfer pipes passing through the fins. The heat transfer pipes are connected to a known outdoor unit (not shown) through a pipe (not shown) so that a cooled or heated refrigerant is supplied to the heat exchanger 16 from the outdoor unit.

In the air conditioner 100 configured as described above, when the turbofan 1 is rotated, the air in the room 17 is sucked into the suction grille 11*a* of the decorative panel 11. Then, the air from which the dust is removed by the filter 12 is guided by the bellmouth 14 that forms a main body air inlet 10*c*, and is then sucked into the turbofan 1.

The air sucked into the turbofan 1 from the lower side substantially upward is blown out in a substantially horizontal direction from the turbofan 1. When the air thus blown out passes through the heat exchanger 16, the heat is exchanged and/or the humidity is adjusted. After that, the air is blown out to the room 17 through the panel air outlet 11*b* with the flow direction changed substantially downward. At this time, the airflow direction is controlled by the airflow-direction vane 13 at the panel air outlet 11*b*.

In the fourth embodiment configured as described above, the advantages of the first to third embodiments described above can be obtained by employing the turbofan 1 according to the above-mentioned embodiments, and thus a high-quality, high-performance, and low-noise air conditioner can be obtained. Thus, even when a pressure dropping member through which air can pass is present on the main body air inlet 10*c* side of the turbofan 1, on the panel air outlet 11*b* side, or on both the sides, the blade leading edges 4*a* are curved, and hence separation is less liable to occur, thereby maintaining the low noise. That is, as a specific example, the pressure dropping member arranged at the air inlet is the filter 12. Even when dust is accumulated through long-term operation to increase the airflow resistance, the blade leading edges 4*a* are curved, and hence separation is less liable to occur, thereby maintaining the low noise even in the long-term operation. Further, when the pressure dropping member arranged at the panel air outlet 11*b* is an air conditioning unit such as the heat exchanger 16 and a humidification rotor, a uniform air velocity distribution is obtained, and hence such an advantage that heat exchange and moisture release can be effectively carried out by the entire heat exchanger 16 and humidification rotor can be obtained. In addition, even when the heat exchanger 16 has a substantially rectangular shape and the distance between the turbofan 1 and the heat exchanger 16 is non-uniform, separation is less liable to occur, thereby capable of reducing the noise. As a result of the above, a uniform blowing-out air velocity distribution can be obtained, and it is possible to prevent generation of a local high-velocity region on the blade surface. In addition, in the case of the air conditioner including the heat exchanger installed on the downstream side with respect to the turbofan, the air velocity to the heat exchanger becomes uniform, and the turbulence does not collide, thereby reducing the noise.

Although the details of the present invention are specifically described above with reference to the preferred embodiments, it is apparent that persons skilled in the art may adopt various modifications based on the basic technical concepts and teachings of the present invention.

REFERENCE SIGNS LIST

1 turbofan, 2 main plate, 2*b* main plate outer periphery, 3 shroud, 3*b* shroud outer periphery, 4 blade, 4*a* blade leading edge, 4*a*1 inner peripheral-side blade leading edge section, 4*a*11 inner peripheral-side blade leading edge section main plate-side portion, 4*a*12 inner peripheral-side blade leading edge section tip-side portion, 4*a*13 main plate-side blade tip portion, 4*a*2 shroud-side leading edge section, 4*a*3 blade tip section, 4*b* blade trailing edge, 4*b*1 main plate-side blade trailing edge, 4*b*11 main plate-side trailing edge end point, 4*b*2 shroud-side blade trailing edge, 4*b*22 shroud-side trailing edge end point, 4*c* blade outer surface, 4*d* blade inner surface, 4*j* point of curvature of trailing edge, 10 air conditioner main body, 10*c* main body air inlet, 11*a* suction grille, 11*b* panel air outlet, 15 fan motor, 16 heat exchanger, 100 air conditioner

The invention claimed is:

1. A turbofan, comprising:

a shroud arranged on a suction side;

a main plate arranged to be opposed to the shroud; and a plurality of blades arranged between the shroud and the main plate, the shroud being formed so that a diameter is increased toward the main plate, the main plate having a radially center part that is protruded toward the shroud, the plurality of blades each being formed so that a blade leading edge is positioned closer to a rotational center axis than a blade trailing edge, wherein the blade leading edge is inclined to be distanced from the rotational center axis RC as the blade leading edge is distanced from the main plate and has a zigzag shape including two convex portions that protrude forward in the rotational direction of the fan, wherein the blade leading edge comprises:

an inner peripheral-side leading edge section;

a shroud-side leading edge section; and a blade tip section positioned between the inner peripheral-side leading edge section and the shroud-side leading edge section, wherein the inner peripheral-side leading edge section comprises:

an inner peripheral-side blade leading edge section main plate-side portion;

an inner peripheral-side blade leading edge section tip-side portion;

a main plate-side blade tip portion; and a main plate-side shoulder surface portion, wherein the inner peripheral-side blade leading edge section main plate-side portion, the main plate-side blade tip portion, the main plate-side shoulder surface portion, and the inner peripheral-side blade leading edge section tip-side portion are formed in the stated order from the main plate toward the shroud, wherein the inner peripheral-side blade leading edge section main plate-side portion is distanced from the blade trailing edge and the rotational center axis as the inner peripheral-side blade leading edge section main plate-side portion is distanced from the main plate, wherein the inner peripheral-side blade leading edge section main plate-side portion is bent in a direction to form a concavity that extends oppositely to the rotational direction, wherein the main plate-side blade tip portion is a convex portion that protrudes forward in the rotational direction, wherein the main plate-side shoulder surface portion is distanced from the rotational center axis while approaching the blade trailing edge as the main plate-side shoulder surface portion is distanced from the main plate-side blade tip portion, and wherein the inner peripheral-side blade leading edge section tip-side portion is distanced from the blade trailing edge and the rotational center axis as the inner peripheral-side blade leading edge section tip-side portion is distanced from the main plate.

2. A turbofan according to claim 1, wherein, when viewed in a plane orthogonal to the rotational center axis, the blade tip section is positioned forward in the rotational direction with respect to the main plate-side blade tip portion.

3. A turbofan according to claim 1, wherein, when the inner peripheral-side blade leading edge section main plate-side portion and the inner peripheral-side blade leading edge section tip-side portion are viewed from a forward side toward a rearward side in the rotational direction, a first angle is formed between a straight line parallel to the rotational center axis and a thickness centerline of the inner peripheral-side blade leading edge section main plate-side portion, and a second angle is formed between the straight line parallel to the rotational center axis and the inner peripheral-side blade leading edge section tip-side portion, and wherein the following relationship is satisfied: the first angle is greater than or equal to the second angle.

4. A turbofan according to claim 3, wherein each of the thickness center lines is bent forward in the rotational direction so that each of the angle relating to the inner peripheral-side blade leading edge section main plate-side portion and the angle relating to the inner peripheral-side blade leading edge section tip-side portion is gradually increased from a position separated from the main plate.

5. A turbofan according to claim 1, wherein the blade trailing edge is positioned on a virtual cylindrical surface formed by a main plate outer periphery and a shroud outer periphery, and comprises a main plate-side blade trailing edge, a shroud-side blade trailing edge, and a point of curvature, wherein the point of curvature is positioned at a boundary between the main plate-side blade trailing edge and the shroud-side blade trailing edge, wherein the main plate-side blade trailing edge is positioned on the main plate side with respect to the point of curvature, and the shroud-side blade trailing edge is positioned on the shroud side with respect to the point of curvature, wherein a blade outer surface of the main plate-side blade trailing edge until the point of curvature is inclined rearward in the rotational direction as the blade outer surface is distanced from the main plate, and a blade inner surface of the main plate-side blade trailing edge until the point of curvature is inclined forward in the rotational direction as the blade inner surface is distanced from the main plate, so that a thickness of the main plate-side blade trailing edge is gradually reduced from a main plate-side trailing edge end point to the point of curvature, wherein the shroud-side blade trailing edge is inclined rearward in the rotational direction both in the blade outer surface and the blade inner surface, and is connected to the shroud at a shroud-side trailing edge end point, and wherein the blade outer surface of the shroud-side blade trailing edge is inclined rearward in the rotational direction more on the shroud side as compared to the main plate side, and is inclined rearward in the rotational direction from the main plate to the shroud to be gradually distanced from the blade leading edge as the blade outer surface is distanced from the main plate.

6. An air conditioner, comprising:

a main body having an air inlet and an air outlet formed through one surface thereof;

the turbofan according to claim 1, which is arranged inside the main body to be communicated with the air inlet; and an air conditioning unit arranged between the turbofan and the air outlet.

7. A turbofan according to claim 1, wherein the main plate-side blade tip portion is a convex portion that protrudes forward in the rotational direction, wherein the main plate-side shoulder surface portion is distanced from the rotational center axis while approaching the blade trailing edge as the main plate-side shoulder surface portion is distanced from the main plate-side blade tip portion, and wherein the inner peripheral-side blade leading edge section tip-side portion is distanced from the blade trailing edge and the rotational center axis as the inner peripheral-side blade leading edge section tip-side portion is distanced from the main plate.

* * * * *